United States Patent [19]

Long

[11] 4,393,635

[45] Jul. 19, 1983

[54] INSULATED WALL CONSTRUCTION APPARATUS

[76] Inventor: Robert T. Long, 3216 Shasta Ct., NE., Cedar Rapids, Iowa 52402

[21] Appl. No.: 259,039

[22] Filed: Apr. 30, 1981

[51] Int. Cl.[3] ..... E04B 2/84; E04B 1/74; E04C 2/26

[52] U.S. Cl. ..... 52/309.11; 52/105; 52/250; 52/268; 52/309.12; 52/410

[58] Field of Search ..... 52/410, 127, 98, 309.11, 52/309.12, 250, 268, 105; 249/40, 41, 42, 43, 213, 214, 216, 217, 96, 97

[56] References Cited

U.S. PATENT DOCUMENTS

| | | | |
|---|---|---|---|
| 2,339,489 | 1/1944 | Kublanow . | |
| 2,595,123 | 4/1952 | Callan | 52/410 |
| 2,718,138 | 9/1955 | Jones | 52/410 |
| 2,769,333 | 11/1956 | Reintjes | 52/410 |
| 2,964,821 | 12/1960 | Meehan | 52/410 |
| 3,000,144 | 9/1961 | Kitson . | |
| 3,131,514 | 5/1964 | Siek . | |
| 3,300,931 | 1/1967 | Lutze . | |
| 3,304,676 | 2/1967 | Sallie et al. . | |
| 3,332,187 | 7/1967 | Arcari . | |
| 3,466,222 | 9/1969 | Curtis . | |
| 3,523,395 | 8/1970 | Rutter et al. | 52/410 |
| 3,616,153 | 10/1971 | Downs . | |
| 3,646,715 | 3/1972 | Pope . | |
| 3,701,228 | 10/1972 | Taylor . | |
| 3,798,861 | 3/1974 | Weiss . | |
| 3,816,234 | 6/1974 | Winfield . | |
| 3,879,908 | 4/1975 | Weismann . | |
| 3,965,635 | 6/1976 | Renkert . | |
| 4,052,831 | 10/1977 | Roberts et al. . | |
| 4,109,436 | 8/1978 | Berloty . | |
| 4,157,001 | 6/1979 | Pickles | 52/410 |
| 4,329,821 | 5/1982 | Long et al. | 52/410 |

OTHER PUBLICATIONS

PolyCell Industries, Inc., Technical Bulletin.
Thermocurve System Facts Brochure.

*Primary Examiner*—Alfred C. Perham
*Attorney, Agent, or Firm*—Hill, Van Santen, Steadman, Chiara & Simpson

[57] ABSTRACT

The present invention comprises an improved composite wall structure which includes a pair of outer poured concrete layers which are separated by a high density foam insulating panel which is mounted between the concrete layers and includes a plurality of time mechanisms for holding the insulated layer in place while the concrete is being poured and hardened, wherein the holding means comprises metal rods and are low heat conductive rods such as polyglass impregnated plastic rods upon which a pair of holding spools are mounted which engage opposite sides of the insulating panel so as to hold it in a predetermined position.

Also disclosed is a novel corner form arrangement.

15 Claims, 9 Drawing Figures

FIG. 1
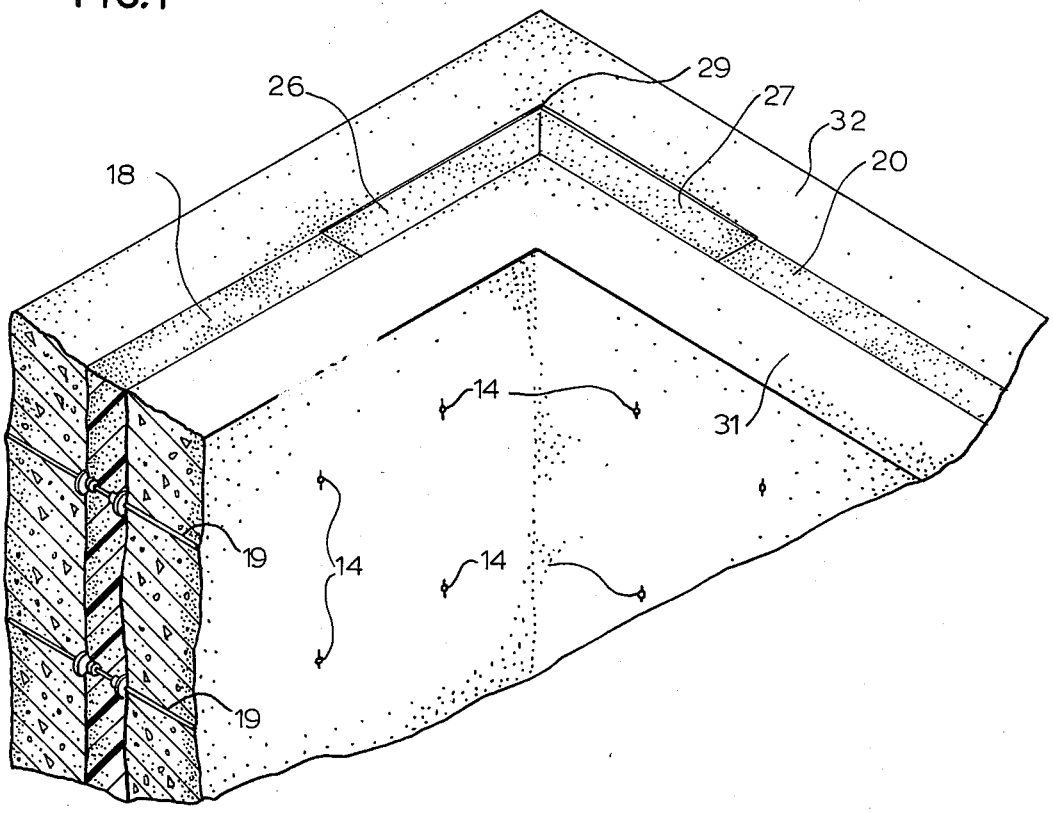
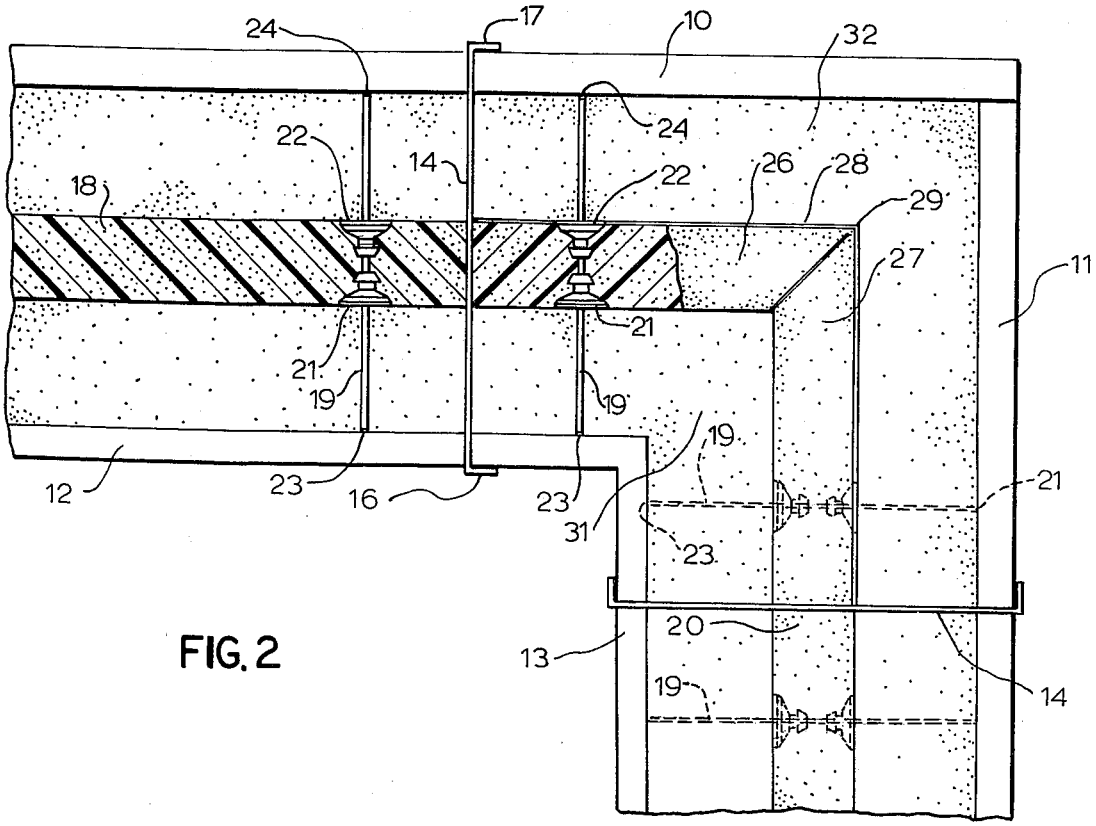
FIG. 2

INSULATED WALL CONSTRUCTION APPARATUS

BACKGROUND OF THE INVENTION

1. Field of the Invention

The present invention relates in general to apparatus and means for constructing insulated walls wherein an inner insulating layer of high density polystyrene is held in a form by low heat conductive rods so as to hold the insulation in place while concrete is being poured and also to assure that the finished wall has a very low heat conductivity so as to significantly reduce energy transfer.

2. Description of the Prior Art

It is well known in prior art construction to utilize wooden or metal forms for holding concrete during the pouring. U.S. Pat. No. 3,750,355 discloses a pair of opposed parallel outer sheets of concrete in which an inner layer of foamed insulation is mounted.

The use of a sheet of polystyrene against one of the forms about which concrete is poured is also known. However, thie requires a two-stage pour, and the forms have to be set two separate times which is very costly.

SUMMARY OF THE INVENTION

It is an object of the present invention to provide an improved insulating wall comprising layers of insulating material and concrete utilizing improved rods which pass through a sheet of insulating panel such as high density polystyrene, and where the rods are made of metal or of low heat conductivity material such as polyglass impregnated plastic, and further including novel holding means mounted on the rod which engage one or both sides of the insulating sheet so as to hold it in a predetermined spatial relationship between the forms so that concrete can be poured on both sides thereof, thus resulting in a composite wall of very low conductivity.

Another object of the invention is to provide holding spools which are frictionally connected to the foam sheet of insulation. Alternatively, the spools may be glued into the sheet. Lock means are provided between the rods and spools so as to lock the rod relative to the spools so as to provide the proper spacing of the insulating sheets.

Several different forms of the lock are provided, such as indentations on the spool and extensions on the rod which are receivable in such indentations. The spools may also have flat portions so as to provide a proper angular orientation of the spool relative to the plastic sheet.

Another object of the invention is to provide a novel corner arrangement wherein sheets of the insulating material are provided with a 45° surfaces which mate to form a corner and wherein a layer of fiberglass is glued to the outer surfaces of the corner so as to provide a hinge and firmly hold the plastic sheet between the inner and outer layer of concrete as the sheet is poured.

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which:

BRIEF DESCRIPTION OF THE DRAWINGS

FIG. 1 is a perspective view illustrating a corner portion of a composite wall according to the invention.

FIG. 2 is a top plan view of the corner composite wall.

DESCRIPTION OF THE PREFERRED EMBODIMENTS

Figures 3, 4, 5, 6, 7, 8, 9:
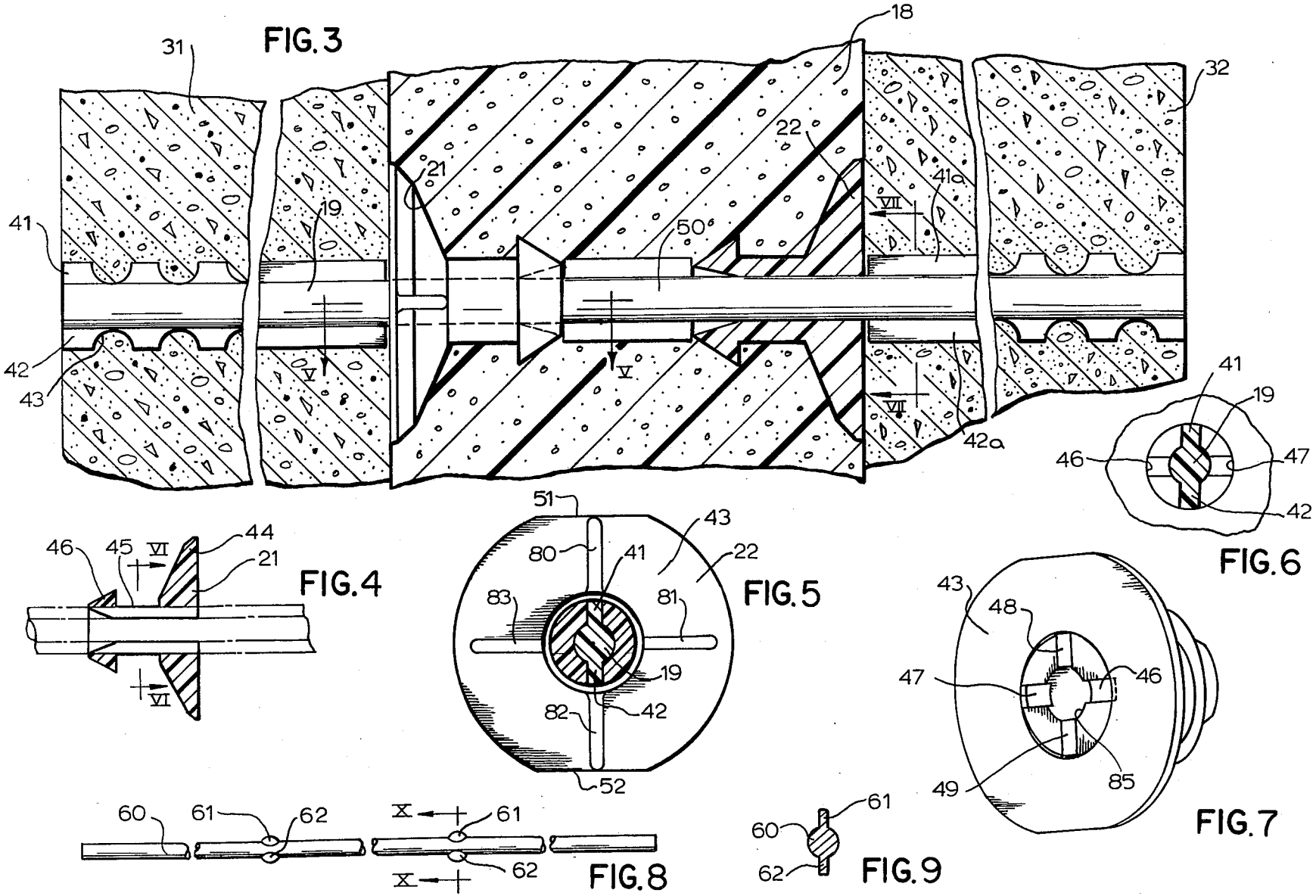
FIG. 3 is a sectional view through the composite wall illustrating the novel spools and rod of the invention.
FIG. 4 is a sectional view through a spool of the invention.
FIG. 5 is a sectional view taken on a line VI—VI of FIG. 4.
FIG. 6 is a view from VII—VII in FIG. 3.
FIG. 7 is a perspective view of the spool of the invention.
FIG. 8 is a side plan view of the rod of the invention.
FIG. 9 is a sectional view taken on line X—X from FIG. 8.

A composite wall structure according to the invention can be constructed by providing outer forms 10 and 11 as illustrated in FIG. 2, and inner forms 12 and 13. The forms are connected by conventional strap means 14 which are formed with holding ends 16 and 17 that extend through and engage the outside of the forms.

Between the forms are mounted thermally insulating boards which might be constructed of polystyrene which might have varying thicknesses such as 2, 3, 4 inches or up to 24 inches in thickness, and which might have standard widths of 24-inch, 36-inch or 48-inches, and standard lengths of 8 ft., 9 ft., 10 ft., and special lengths up to 18 ft. The longitudinally extending boards 18, for example, stand to the left from the corner member comprising insulating board sections 26 and 27 and the planar insulating board member 20 extends downwardly relative FIG. 2 from the corner member forming the corner sections 26 and 27. The insulating board members are held in place in the forms by spools 21 and 22 which are mounted in the opposite side faces of the boards 18, 26, 27 and 20, as shown. The spools 21 and 22 are formed with openings through which rods 19 extend and locking means are provided between the spools 21 and 22 and the rods so that the rods hold the boards 18, 26, 27 and 20 in predetermined spatial relationship relative to the forms 10 and 12, so that the boards will not move as the concrete is poured on either side thereof and hardens. The spools are also provided with ribs 80 to 83 on the inner surfaces to lock them relative to the boards.

After the forms and insulating board arrangements have been positioned, the concrete is poured on either side of the insulating sheets to fill the forms and concrete is allowed to harden. After the concrete is hardened, the forms 10 and 12 are removed, and the ends of the form rods 14 break off flush with the outer wall of the concrete to form the composite wall illustrated in FIG. 1.

One novel feature of the present invention comprises the polystyrene folding corner insulating board illustrated in FIG. 2, wherein two planar board sections 26 and 27 are formed with mating 45° angle ends and a sheet of fiberglass material 29 is glued to the outer surfaces of the boards 26 and 27 to form a hinge as shown in FIG. 2. Thus, the hinged corner section will provide insulation in the corner portion of the wall and in shipment, the corner section can be pivoted around the outer corner so as to provide a flat section for shipping.

FIGS. 3 through 7 illustrate in detail the novel rods and spindles of the invention, and in FIG. 3, for example, the rod 19 is formed with ribs 41 and 42 displaced 180° relative to each other at the end portions, and the center portion 50 of the rod is left free of the ribs 41 and 42 so that the spools 21 and 22 can be locked by the rod and held in place relative to the ends of the rod 19 so that the insulating board 18 will not move. The spools 21 and 22 each have an enlarged head portion 44 and 43, respectively, which can be indented into the surface of the insulating board 18 by pressure so as to lock it either by the pressure applied or by glue so that the spool will not rotate relative to the board. As shown in FIG. 5, the flange 43 of the spools is formed with flat portions 51 and 52 displaced 180° from each other so as to provide an index used when mounting the rod 19 and locking it relative to the spool. Extending from the flanges 43 and 44 is a central portion 45 through which the rod 19 can be extended and then an inner head portion 46 which is enlarged relative to the portion 45 so as to lock into the foam sheet 18.

The spools are provided with center openings 85, as illustrated in FIG. 7 and slots 48 and 49 which extend on opposite sides of the center opening, and with indentations 46 and 47 which are partially formed into the spool as illustrated in FIG. 6, for example.

During assembly, the rod 19 is inserted through the spool 22, for example, with the ribs 41 and 42 aligned with the slots 48 and 49 and then through the spool 21 with the ribs 41 and 42 aligned with the slots 48 and 49 and after the center portion 50 is centered in the insulating board 18, the rod 19 is turned 90°, so that the ends of the ribs 41 and 42 and 41*a* and 42*a* which engage the spools move from the slots 48 and 49 to the indentations 47 and 46 to lock the rod to the spools and thus to assure that the panel 18 will not move when the concrete is being poured.

As is illustrated in FIG. 7, tapered ramps 51 can be provided between the slot 49 and the indentation 47, and the slot 48 and the indentation 46 so that the ends of the ribs 41 and 42 and 41*a* and 42*a* will ride up the ramps 51 and then lock in the indentations 47 and 46, respectively.

FIG. 8 is a view of a modified form of the rod which is designated as 60, which has locking extensions 61 and 62 formed so as to lock with the spools 21 and 22, respectively.

FIG. 9 is a sectional view taken on line X—X in FIG. 8.

It has been discovered that the composite wall and corner according to the invention provides a poured concrete wall which is very energy efficient so that the very small heat loss will pass through the wall. The cost of the system is very low. The use of rods of low heat conductivity material such as polyglass impregnated plastic results in very low heat loss through the walls.

The invention also can be used for forming tilt-up and pre-cast walls. It has also been discovered that conduction through the walls is 70% higher with steel rods than with using polyester insulating rods, so the use of the insulating rods is very desirable.

Rods may be constructed of fiber glass reinforced polyester produced by the pultrusion process. Other common fibers which can be used are graphite, boron and other reinforcing fibers can also be constructed of epoxy resins and other types of laminating and reinforcing resins.

Rods are of high strength with undercuts 43 to facilitate gripping and tie to the concrete to mechanically tie the two concrete slabs together to transfer loads between them and prevent them from separation.

The insulation board can be organic or inorganic insulation material.

The sheet material 29 may also be spun bond thermal or thermo setting plastic. This material may be in the form of plastic film with adhesive pre-applied.

The corners of the board could also be molded to form a corner. Alternatively, the corners could be formed by fabricating the joining members.

Although the invention has been described with respect to preferred embodiments, it is not to be so limited as changes and modifications may be made therein which are within the full intended scope as defined by the appended claims.

I claim as my invention:

1. An insulating wall comprising two spaced outer layers of form-poured concrete; a high density insulating board disposed between said outer layers; a plurality of rods extending perpendicularly through said insulating layer and further extending substantially from respective outer surfaces of said outer layers; and a plurality of retainer means mounted to receive and immovably hold a rod for fixing the lateral position of said rods with respect to said insulation layer, whereby said rods abut said form during pouring of said concrete to retain said interior layer substantially immovably during pouring and are retained in said concrete after curing for forming a mechanical connection between said interior layer and each of said outer layers, wherein said retainer means comprises a pair of spools formed with central openings that can be inserted into opposite sides of said insulating board, wherein said spools each have an enlarged outer flange that can be depressed into the surface of said board and a central portion smaller than said flange, and wherein said spools also each have an inner portion which is larger than said central portion for locking said spool to said board.

2. An insulating wall according to claim 1 wherein ribs are formed on the innerside of said flange to lock the spool to said board to prevent said spool from turning relative to said board.

3. An insulating wall according to claim 1 wherein said flange includes index means to indicate the orientation of the spool relative to said board.

4. An insulating wall according to claim 1 wherein said rods have projections thereon and a rod can be inserted through the central openings of a pair of said spools and locking means on each of said spools for locking the spools to said rod to hold said board in a predetermined spatial position between said outer layers of concrete.

5. An insulating wall board according to claim 1 wherein said rods are made of material which has low thermal conductivity.

6. An insulating wall board according to claim 5 wherein said rods are made of polyglass impregnated plastic.

7. An insulating board according to claim 5 wherein said rods may be made of fiberglass reinforced polyester.

8. An insulating wall according to claim 1 wherein said insulating board is formed of two sections which are pivotally connected together to form a corner.

9. An insulating wall according to claim 8 wherein said two sections have 45° mating ends.

10. An insulating wall according to claim 9 wherein fiberglass sheet material is attached to said sections to form a hinge.

11. An insulating board according to claim 1 wherein said rods have undercuts at their ends to mechanically tie said concrete slabs together.

12. An insulating board according to claim 8 wherein said two sections are joined together by spun bond plastic.

13. An insulating wall comprising, two spaced outer layers of form-poured concrete, a high density insulating board disposed between said outer layers, a plurality of rods extending perpendicularly through said insulating layer and further extending substantially from respective outer surfaces of said outer layers, a plurality of retainer means mounted to receive and immovably hold a rod for fixing the lateral position of said rods with respect to said insulation layer, whereby said rods abut said form during pouring of said concrete to retain said interior layer substantially immovably during pouring and are retained in said concrete after curing for forming a mechanical connection between said interior layer and each of said outer layers, wherein said retainer means comprises a pair of spools formed with central openings that can be inserted into opposite sides of said insulating board, wherein said rods have projections thereon and a rod can be inserted through the central openings of a pair of said spools and locking means on each of said spools for locking the spools to said rod to hold said board in a predetermined spatial position between said outer layers of concrete, and wherein said central openings are a bayonet connection so that said rods and projections can pass therethrough in one angular orientation and said projections can be locked to said spools by rotating said rods relative to said spools.

14. An insulating wall according to claim 13 including a depression in said flange for receiving said projections to lock said rod to said flange.

15. An insulating wall according to claim 14 including ramps formed on said spools between said depressions and said central opening.

* * * * *